US005484203A

United States Patent [19]

King et al.

[11] Patent Number: 5,484,203

[45] Date of Patent: Jan. 16, 1996

[54] MIXING DEVICE

[75] Inventors: Leonard T. King, Long Beach; Leo Nelmida, Lake Forest; Frank Estrada, Long Beach, all of Calif.

[73] Assignee: Komax Systems Inc., Wilmington, Calif.

[21] Appl. No.: 319,838

[22] Filed: Oct. 7, 1994

[51] Int. Cl.[6] ..... B01F 5/06

[52] U.S. Cl. ..... 366/337

[58] Field of Search ..... 366/336, 337, 366/338, 339, 340; 138/37, 42, 38

[56] References Cited

U.S. PATENT DOCUMENTS 4,019,719 4/1977 Schuster ..... 366/338
4,744,928 5/1988 Meier ..... 366/337
4,758,098 7/1988 Meyer ..... 366/337
4,850,705 7/1989 Horner ..... 366/338
5,378,063 1/1995 Tsukada ..... 366/337

*Primary Examiner*—Robert W. Jenkins
*Attorney, Agent, or Firm*—Malcolm B. Wittenberg

[57] ABSTRACT

An apparatus for mixing materials having no moving parts in which a plurality of elements are fitted into a conduit. At least some of the mixing elements and axially overlap with adjacent mixing elements. Each axially overlapping region provides a mixing matrix introducing complex velocity vectors into the materials to be mixed. A drift space subsequent to the matrix enhances the mixing operation.

9 Claims, 5 Drawing Sheets

MIXING DEVICE

TECHNICAL FIELD OF INVENTION

The present invention deals with a material mixing apparatus which contains various arrays of mixing elements which are related to one another in order to maximize the mixing of fluid streams passing therein. In judiciously arranging the various motionless mixing elements pursuant to the present invention, enhanced mixing can be achieved over comparable devices of the prior art.

BACKGROUND OF THE INVENTION

It has long been realized that motionless mixers if made to work efficiently, provide certain economic advantages over dynamic mixers for, as the name implies, motionless mixers employ no moving parts. As such, motionless devices are generally less expensive to configure and certainly much less expensive to maintain while providing the user with an extended useful life for the mixer product in service.

Prior art approaches to motionless mixers have generally involved expensive machining, molding, casting or other fabrication of the component mixer elements coupled with some type of permanent attachment between elements and a conduit and/or between elements within a conduit. The resulting cost and difficulty of manufacture results in a relatively expensive end product. Moreover, many of the prior mixers provide less than complete mixing particularly with respect to material flowing along the walls of the conduit. This so-called "wall-smearing" is related to the parabolic velocity profile of a fluid having laminar flow in a pipe where the fluid velocity is small or zero along the wall surfaces.

Despite their limitations, static or motionless mixers are in common use in many industrial fields and are applied to both laminar and turbulent flow applications. A wide variety of mixing element designs are available from different manufacturers. Mixing elements are installed in a tube or pipe conduit in series and are fixed in position relative to the conduit wall. The cross-section is usually round but can be square or even rectangular. Materials introduced to the inlet or upstream side of the conduit on a continuous flow basis emerge mixed.

The number of mixing elements required to complete a given mixing task can range from two to twenty or more depending on the difficulty of the mixing application. In general, more mixing elements are required to solve laminar flow mixing problems than are needed in turbulent flow situations. One of the most difficult laminar flow mixing problems, for example, is to mix a small quantity of a low viscosity additive into a much higher viscosity main product flow. Mixing involves the application of the principals of distribution and dispersion.

Referring to FIG. 1, it is seen that a small amount of an additive "A" is introduced on a continuous flow basis to a continuous main product flow "B". The two components then pass through a mixing system. The additive "A" is divided into many small components by the mixing system and the stream exits with the additive distributed across the cross-section of the main flow "B". The typical distance "S" between the concentration centers of the additive is small relative to the main flow diameter "D". Good distribution of additive "A" in stream "B" has been achieved.

The concept of dispersion is shown in FIGS. 2A and 2B. In FIG. 2A, the additive "A" is distributed in the main flow stream "B" material where molecular diffusion between "A" and "B" is virtually zero. The concentration values are either 0% or 100% or, in other words, the intensity "I" of "A" and "B" has a value of either 0% or 100%. In other words, zero dispersion has been achieved. However, in FIG. 2B some degree of molecular diffusion has occurred and the range of the intensity value found in the flow stream as measurements are taken across the conduit is now less than 0% to 100%.

It is obviously a goal in any mixing device to improve distribution and dispersion of component fluid streams. However, this is oftentimes difficult if this goal is attempted by simply adding more mixing elements. The addition of mixing elements often results in pressure drops across the mixing system while such systems tend to increase in length and cost to a point where such parameters prove prohibitive. Furthermore, small filament streams of component "A" can oftentimes tunnel through the mixing structure without further reduction in size.

In 1975, Komax Systems revolutionized the field of mixing by the invention disclosed in its U.S. Pat. No. 3,923,288. The '288 patent disclosed a stationary material mixing apparatus which, as shown in FIG. 3, included a conduit 2 having an internal chamber 4 in which a plurality of elements 6 and 8 are fitted. Element 6 was shown to include a central flat portion 10, the plane of which was intended to be generally aligned with the longitudinal axis of chamber 4. First and second ears 12 and 14, rounded or otherwise configured at their outside peripheries for general fit to the wall of chamber 4, were bent upward and downward from the flat portion 10. A second pair of ears 16 and 18 at the opposite side of flat portion 10 were bent downward and upward, respectively. The outside peripheral edges of ears 16 and 18 were also shown to be rounded or otherwise configured for general fit to the wall of chamber 4. Elements 6 and 8 were formed from a single flat sheet by a punch press. The angle $\lambda$ between ears 12–14, 16–18, 22–24 and 26–28 was taught to be preferably in the range of about 30° to 120°.

When a pair of elements 6 and 8 were nested together, the axially overlapping portions of the elements where the ears mesh defined what can be termed a "mixing matrix" zone where the longitudinally moving material has counter-rotating velocity vectors induced thereon with simultaneous inward and outward radial vectors. These complex mutually opposed angular and radial vectors result in mutual shearing effects which cause the materials to mix and recombine in a different configuration subsequent to the mixing matrix as the materials flow briefly past the flat central region (10, 20) of the elements 6 or 8. This flat central region (10, 20) or non-axially overlapping length of the element 6,8 has been found to contribute significantly to the successful operation of the invention disclosed in the '288 patent.

It is known that materials proceeding under laminar flow are particularly difficult to mix as a parabolic velocity distribution profile appears across the pipe or conduit. It takes a finite time or pipe length to establish this profile for what is called fully developed flow. If $L_e$ is this length and D is the pipe diameter and $R_e$ is the Reynolds number, then:

$$L_e/D=0.035R_e$$

In mixing plastics, one experiences extremely low Reynolds numbers, usually less than 0.01. As such, the length taken to establish the final laminar profile is very short compared to the pipe diameter. This means extensive mixing is given an opportunity to occur during the residence time in the element flat region. Although the invention disclosed in the '288 patent was a marked advance over the prior motionless mixing devices known at the time, it has been found that improvement could be made to this design to improve the mixing operation particularly when laminar flow conditions were involved.

Applicant's invention can be more readily appreciated when considering the following disclosure and appended drawings wherein FIG. 1 depicts the cross-section of a typical mixing apparatus and graph illustrating a principal of distribution.

FIG. 2 depicts the cross-section of a typical mixing apparatus and graph illustrating a principal of dispersion.

FIG. 3 is an isometric perspective view of the mixing elements made the subject of U.S. Pat. No. 3,923,288.

SUMMARY OF THE INVENTION

The present invention deals with a stationary material mixing apparatus for the mixing of fluid stream. The apparatus comprises a conduit having a length, cross-section, a longitudinal axis through the length and a chamber extending longitudinally through the length. The conduit is provided with openings at a first upstream end and second downstream end and is provided with at least two mixing elements located therein along the longitudinal axis.

The mixing elements comprise a plurality of abutting elements wherein each element has a length along the longitudinal axis where adjacent elements actually overlap defining mixing matrices inducing both counter-rotational angular velocities relative to said longitudinal axis and simultaneously inward and outward radial velocities relative to the longitudinal axis on materials moving through the mixing matrices. Each element is provided with a length along the longitudinal axis where the elements do not axially overlap. The axially non-overlapping lengths of the elements along the length of the longitudinal axis define draft spaces for the recombination of the materials subsequent to movement through the mixing matrices.

Each mixing element is characterized as having a central flat portion aligned along its longitudinal axis and a set of at least three ears emanating in each of either two or four planes from the central flat portion. Each ear within each plane is spaced apart from adjacent ears within that plane by an amount approximately equal to the width of each ear itself.

DETAILED DESCRIPTION OF THE INVENTION

Figure 4:
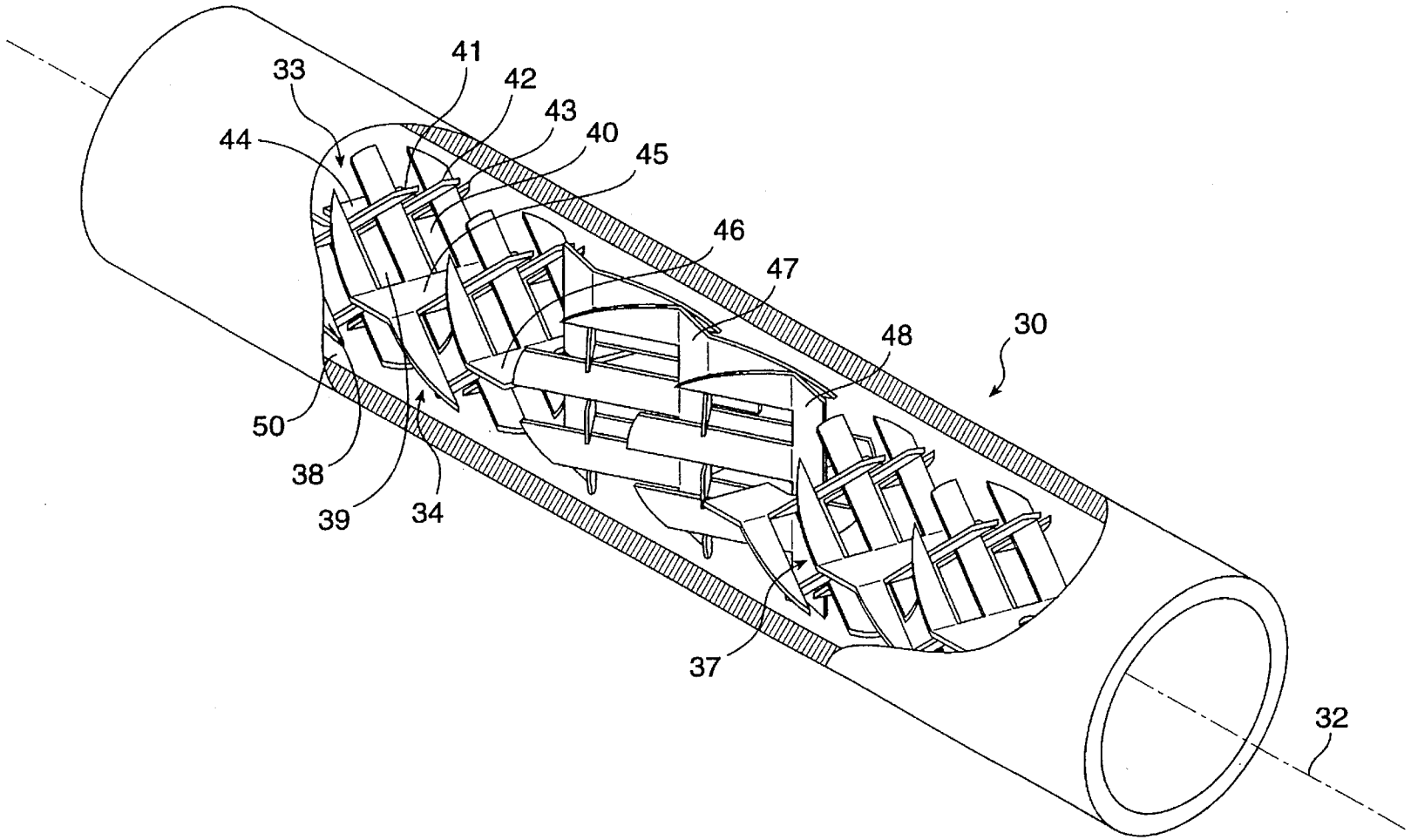
FIG. 4 is an isometric perspective view of the present invention depicting various mixing elements.

The present invention can best be visualized by viewing FIG. 4 in which stationary material mixing apparatus 30 is shown in perspective. In order to visualize the actual mixing elements, conduit 31 is shown in a cutaway fashion. The apparatus is shown having a length, longitudinal axis 32 through said length and a chamber 50 extending longitudinally through said length.

FIG. 4 shows an array of five mixing elements, namely, elements 33, 34, 35, 36 and 37. The number of mixing elements to be employed is a function of a number of factors including the type of flow, be it laminar or turbulent, the viscosity of the components as well as their relative viscosities, the degree of mixing which a particular operation demands as well as the inherent pressure drop which the system can tolerate.

In any event, however, the present invention contemplates the use of at least two mixing elements occupying the entire cross-section of chamber 50 along longitudinal axis 32. The mixing elements comprise a plurality of abutting elements wherein each element has a length along the longitudinal axis where adjacent elements axially overlap defining mixing matrices inducing both counter-rotating angular velocities relative to said longitudinal axis and simultaneous inward and outward radial velocities relative to said longitudinal axis of materials moving through said mixing matrices. In this regard, reference is again made to applicant's U.S. Pat. No. 3,923,288, the disclosure of which is hereby incorporated by reference. As noted in the '288 patent, the various mixing elements can be formed from a single flat sheet by a punch press including a central flat portion, in this instance, portions 44, 45, 46, 47 and 48 which are intended to be generally aligned with longitudinal axis 32 of chamber 50.

Figure 1:
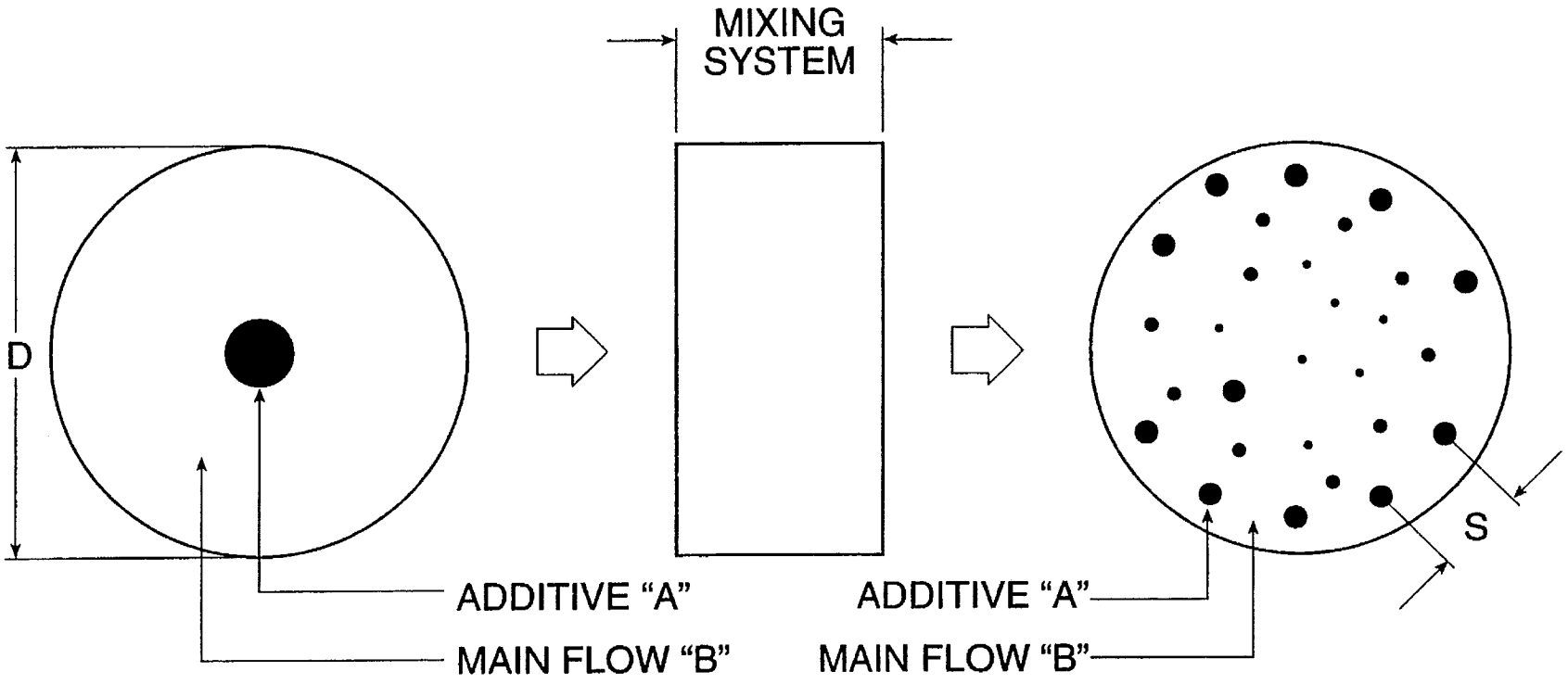
Figure 2B:
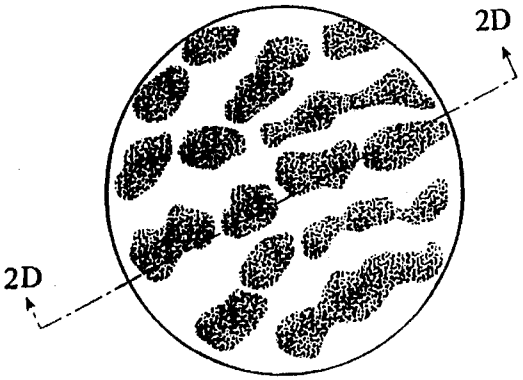
Figure 2D:
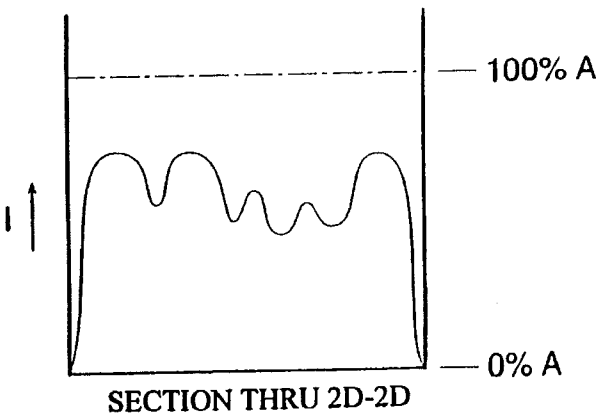
Figure 2A:
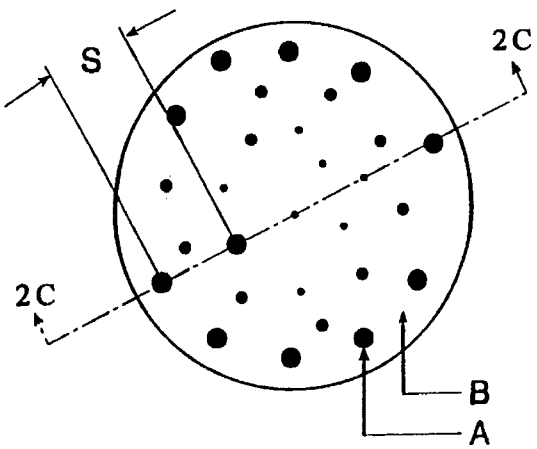
Figure 2C:
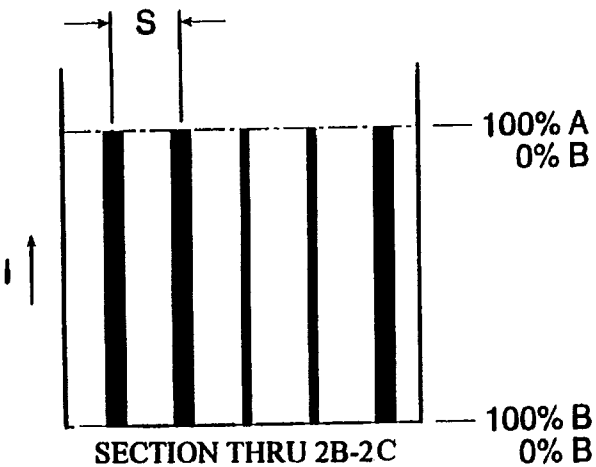
Figure 3:
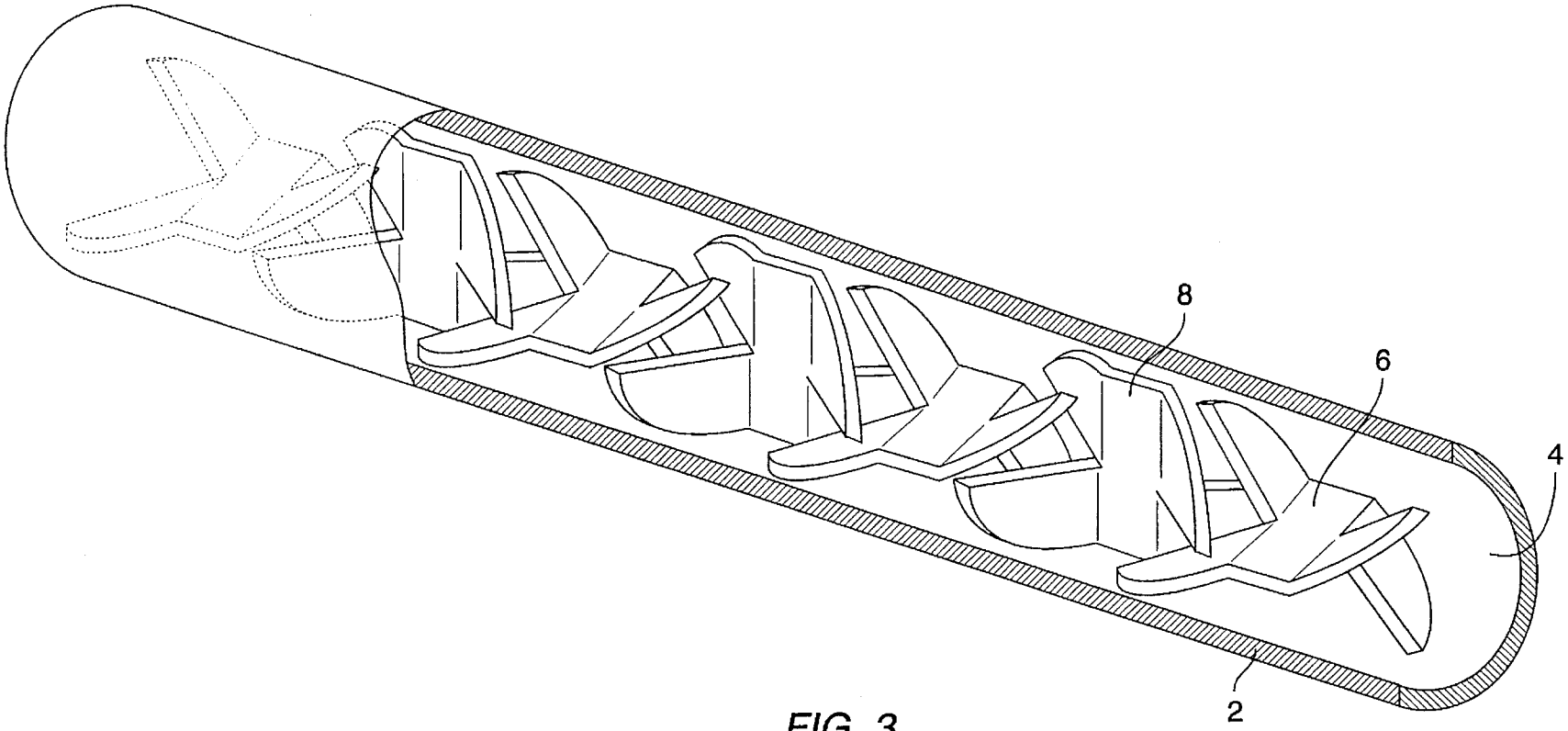
FIG. 3 PRIOR ART
Figure 5:
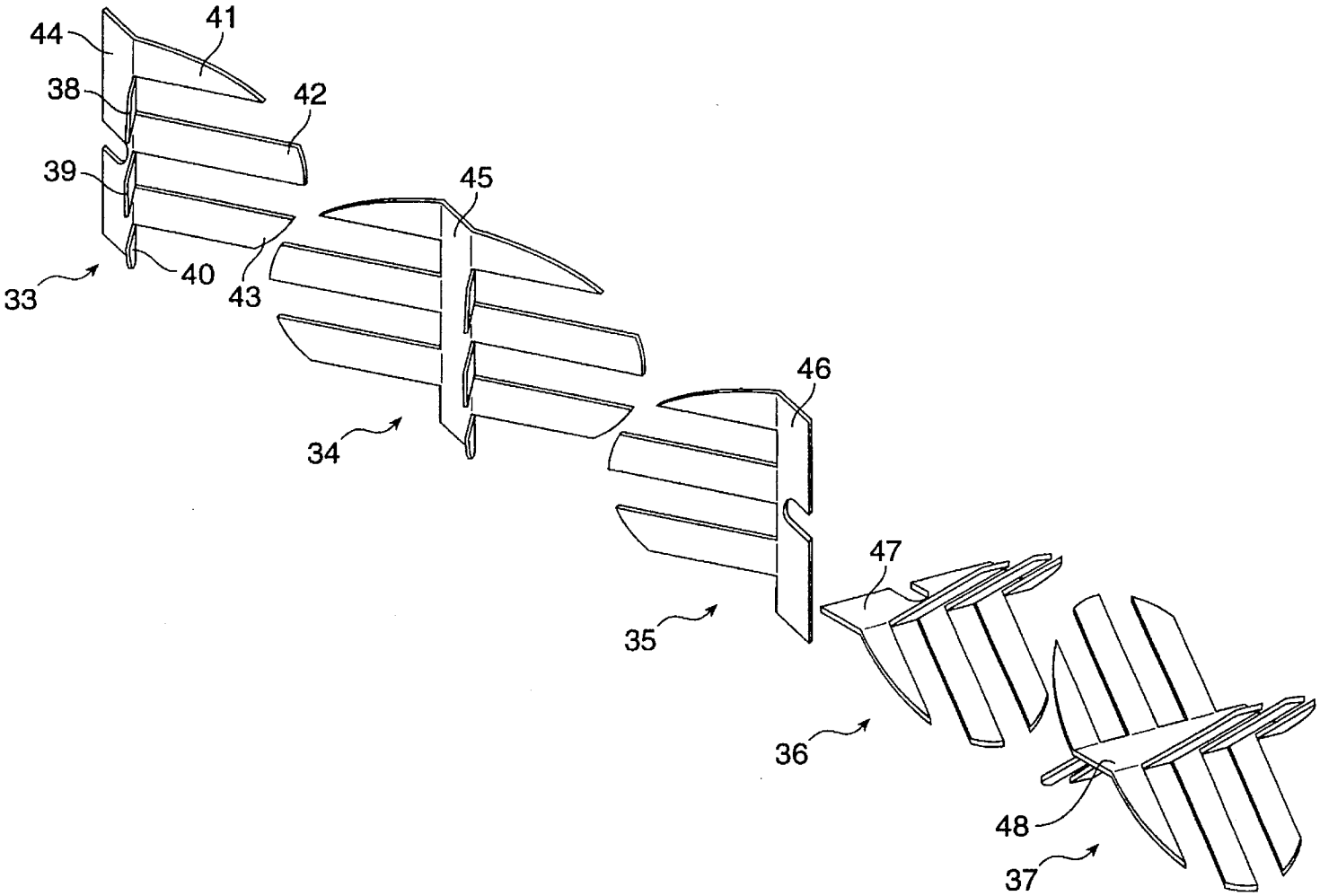
FIG. 5 shows an exploded view of the mixing apparatus of FIG. 4 to more readily visualize individual mixing elements.

As noted, in viewing FIG. 3, the mixing elements of the '288 patent comprise a central flat region and four ears, each ear being a continuous flat sheet of material. It has now been determined that surprising improvement is realized particularly in dealing with laminar flow conditions and where there is a wide disparity between viscosities of materials to be mixed if, connected to the central flat portions 44, 45, 46, 47 and 48 are provided a set of at least three ears emanating in each plane. These various ears are identified as elements 38 through 43 of FIGS. 4 and 5. These ears can ideally be created by cutting single flat sheets so that alternating ears can be bent to create a second plane. Although the present invention is not limited to any particular manner of fabrication, nor is the invention limited to providing the various mixing elements as a unitary piece, the creation of alternating ears pursuant to the present invention results in at least three ears emanating in any given plane from its central flat portion, each ear within each plane being spaced apart from adjacent ears within that plane by an amount approximately equal to the width of each ear itself.

The various mixing elements and their combination can take on a wide variety of configurations while remaining within the spirit and scope of the present invention. It is noted that some of the mixing elements shown in FIGS. 4 and 5, such as mixing elements 34 and 37, are provided with central flat regions 45 and 48, respectively, wherein four planes of ears emanate from each flat section. In addition, mixing elements can comprise configurations such as those shown as elements 33 and 35 where central flat regions 44 and 46, respectively, provide the points of connection to only two planes of ears. In either event, however, it is proposed that sets of ears comprising a mixing element pass through spaces created between ears of adjacent mixing elements when the mixing elements are caused to axially overlap. Ideally, adjacent mixing elements can be permanently attached to one another in order to create a self-supporting unitary mixing matrix where adjacent mixing elements are attached to one another at the point of axial overlap, such as by welding.

In view of the foregoing modifications to the disclosed embodiments within the spirit of the invention will be apparent to those of ordinary skill in the art. The scope of the invention is therefore to be limited only by the appended claims.

We claim:

1. A stationary material mixing apparatus for the mixing of a fluid stream comprising a conduit having length, a cross-section, a longitudinal axis through said length and a chamber extending longitudinally through said length opening at a first upstream and second downstream ends of said conduit and including said longitudinal axis, at least two mixing elements occupying the entire cross-section of said conduit along the longitudinal axis thereof, said mixing elements comprise a plurality of abutting elements wherein each element has a length along the longitudinal axis where adjacent elements axially overlap defining mixing matrices inducing both counter-rotating angular velocities relative to said longitudinal axis and simultaneous inward and outward radial velocities relative to said longitudinal axis on materials moving through said mixing matrices, each element having a length along the longitudinal axis where said elements do not axially overlap, the axially non-overlapping lengths of said elements along the length of the longitudinal axis defining draft spaces for the recombination of said materials subsequent to movement through the mixing matrices, each mixing element being characterized as having a central flat portion aligned along said longitudinal axis and a set of at least three ears emanating in each of four planes from said central flat portion, each ear within each plane being spaced apart from adjacent ears within that plane by an amount approximately equal to the width of each ear itself.

2. The apparatus of claim 1 wherein a first set of ears emanated from an edge of said central flat portion is angled to a second set of ears emanating from the same edge of said central flat portion in the range of approximately 30° to 120°.

3. The apparatus of claim 1 wherein sets of ears comprising a mixing element pass through said spaces created between ears of adjacent mixing elements when said mixing elements are caused to axially overlap.

4. The apparatus of claim 3 wherein adjacent mixing elements are permanently affixed to one another by affixing ears of adjacent mixing elements at their points of axial overlap.

5. A stationary material mixing apparatus for the mixing of a fluid stream comprising a conduit having length, a cross-section, a longitudinal axis through said length and a chamber extending longitudinally through said length opening at a first upstream and second downstream ends of said conduit and including said longitudinal axis, at least two mixing elements occupying the entire cross-section of said conduit along the longitudinal axis thereof, said mixing elements comprise a plurality of abutting elements wherein each element has a length along the longitudinal axis where at least some of said elements actually overlap defining mixing matrices inducing both counter-rotating angular velocities relative to said longitudinal axis and simultaneous inward and outward radial velocities relative to said longitudinal axis on materials moving through said mixing matrices, each element having a length along the longitudinal axis where said elements do not axially overlap, the axially non-overlapping lengths of said elements along the length of the longitudinal axis defining draft spaces for the recombination of said materials subsequent to movement through the mixing matrices, each mixing element being characterized as having a central flat portion aligned along said longitudinal axis and a set of at least three ears emanating in each of at least two planes from said central flat portion, each ear within each plane being spaced apart from adjacent ears within that plane by an amount approximately equal to the width of each ear itself.

6. The apparatus of claim 5 wherein adjacent mixing elements are permanently affixed to one another by affixing ears of adjacent mixing elements at their points of axial overlap.

7. The apparatus of claim 5 wherein a first set of ears emanated from an edge of said central flat portion is angled to a second set of ears emanating from the same edge of said central flat portion in the range of approximately 30° to 120°.

8. The apparatus of claim 5 wherein sets of ears comprising a mixing element pass through said spaces created between ears of adjacent mixing elements when said mixing elements are caused to axially overlap.

9. The apparatus of claim 5 wherein at least some adjacent mixing elements comprise central flat portions aligned along said longitudinal axis wherein said central flat portions are substantially perpendicular to one another and wherein a set of at least three ears emanate in each of two planes from each of said central flat portion.

* * * * *